United States Patent [19]

Goltsos

[11] 4,081,646

[45] Mar. 28, 1978

[54] DEVICE FOR MICROWAVE COOKING

[75] Inventor: Costas E. Goltsos, Weston, Mass.

[73] Assignee: Teckton, Inc., Wellesley, Mass.

[21] Appl. No.: 666,665

[22] Filed: Mar. 15, 1976

[51] Int. Cl.[2] ..... H05B 9/06

[52] U.S. Cl. ..... 219/10.55 E; 99/416; 426/107

[58] Field of Search ..... 99/430, 426, 433, 439, 99/DIG. 14, 448, 416; 426/107, 113, 114, 119, 122, 234, 241, 243; 126/390; 229/43, 2.5; 220/23.8, 20, DIG. 14, DIG. 3, 354, 380; 206/541, 509, 505, 62; 219/10.55 E, 10.55 F, 10.55 M

[56] References Cited

U.S. PATENT DOCUMENTS

| | | | |
|---|---|---|---|
| 2,714,070 | 7/1955 | Welch | 219/10.55 E X |
| 3,107,027 | 10/1963 | Hong | 229/2.5 |
| 3,219,460 | 11/1965 | Brown | 426/107 |
| 3,271,169 | 9/1966 | Baker et al. | 219/10.55 E X |
| 3,302,632 | 2/1967 | Fichtner | 219/10.55 E X |
| 3,490,580 | 1/1970 | Brumfield et al. | 219/10.55 E |
| 3,547,661 | 12/1970 | Stevenson | 126/390 UX |
| 3,835,281 | 9/1974 | Mannix | 219/10.55 E |
| 3,865,301 | 2/1975 | Pothier et al. | 99/DIG. 14 X |
| 3,935,415 | 1/1976 | Moore | 219/10.55 F |

*Primary Examiner*—Arthur T. Grimley
*Attorney, Agent, or Firm*—Wolf, Greenfield & Sacks

[57] ABSTRACT

A differential heating container for simultaneously heat conditioning a multi-component meal in which the individual food components of the meal have different heating requirements. The device includes a tray and cover which are thermoformed from plastic which is transparent to microwave energy. The rims of the tray and cover are arranged to engage each other in a snap-fit which seals the container and means are provided to destroy the seal to facilitate removal of the cover when the meal is to be served. The tray and cover are formed with ridges and walls which, when the tray and cover are combined, engage each other and cooperate to define a plurality of isolated food compartments. When the container is closed, the ridges on the cover overlap both sides of the cooperative ridges on the tray to protect the surfaces of the tray ridges and sidewalls from becoming spattered with any of the food components such as sauces, gravy, etc. Means are provided to selectively shield the container compartments to control the amount of microwave energy to which the individual foods are exposed in the microwave oven.

Also disclosed is a technique for preparing, heating and serving a meal in which the food components are initially placed in the cover compartments and are heated with the container in an inverted configuration. When the meal is served, the container is turned right side up. The technique enables the food to be served in a manner in which the tray has a clean appearance and in which the more moist appearing portions of the food components are on top when served.

1 Claim, 11 Drawing Figures

Fig. 5
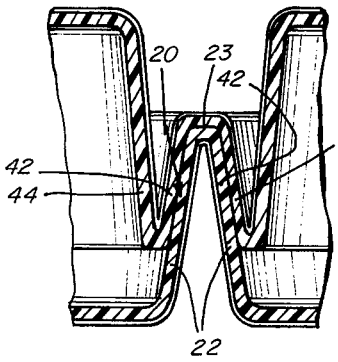
Fig. 6
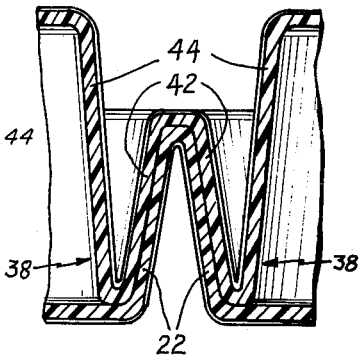
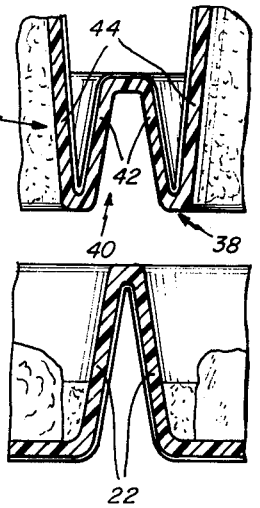
Fig.7
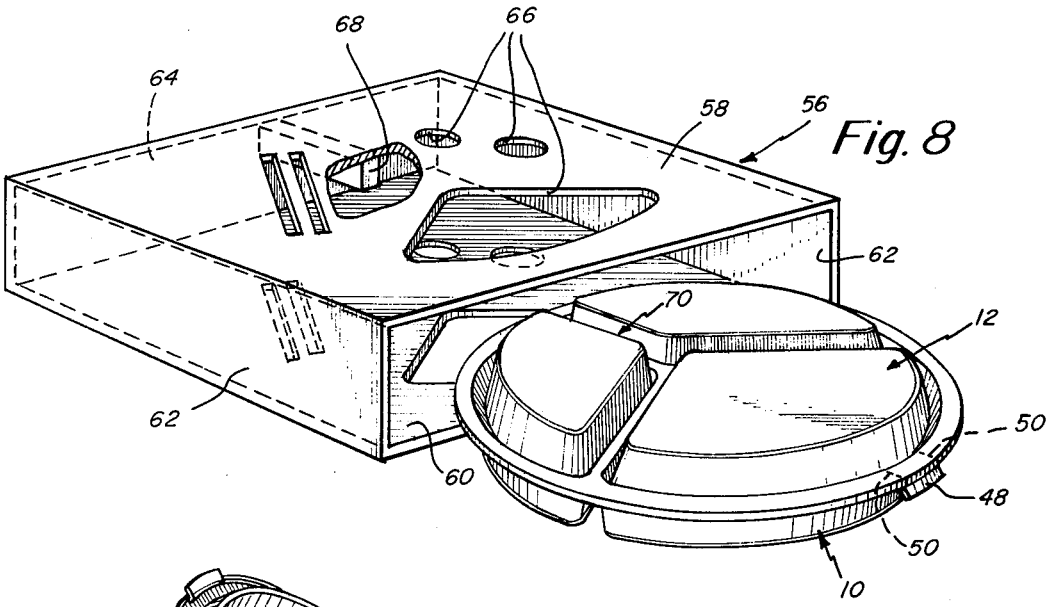
Fig. 8
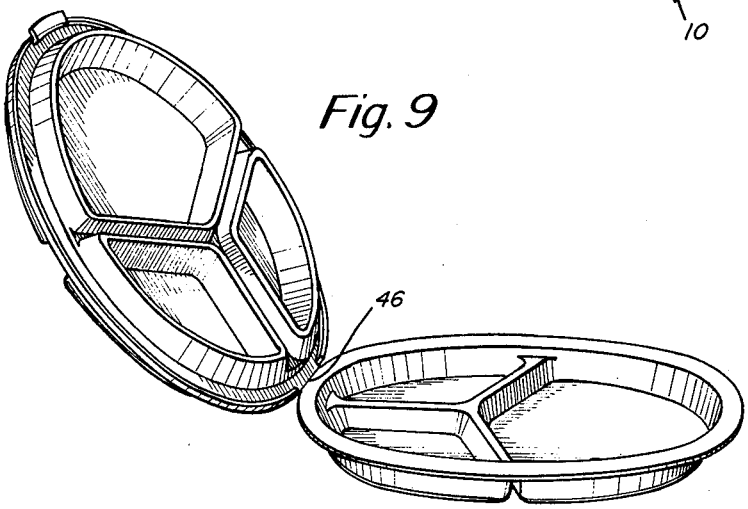
Fig. 9

DEVICE FOR MICROWAVE COOKING

BACKGROUND OF THE INVENTION

This invention relates to devices and method for heating prefrozen or refrigerated prepared meals by fast, microwave techniques. The invention is useful particularly when feeding large numbers of people as in institutional cafeterias, hospitals, fast food establishments, etc. The invention is also suited for use when feeding a limited number of people with special foods such as persons having particular dietary requirements as might be found in a nursing home.

Among the difficulties which have been encountered in the preparation and serving of complete meals by microwave heating has been that because the individual food components generally require different quantities of microwave energy exposure, it is difficult to control the precise exposure of all of the meal components at the same time and in the same oven. Recent years have seen important improvements in the development of differential heating containers receptive to a number of individual food components and which employ shielding means to control the amount of radiation to which each of the individual food components is exposed in the microwave oven. For example, U.S. Pat. No. 3,547,661 describes an enclosure for a multi-component meal in which the enclosure is opaque to the microwave radiation except for radiation-transparent windows formed in the enclosure to expose the various foods to different degrees of microwave energy. Although the techniques disclosed in that patent are believed to have solved the primary difficulties previously encountered (to selectively control the heating of the individual food components), other problems have surfaced in this art. For example, it may sometimes occur that when the meal is heated and served in a multi-compartmented tray, the ridges which separate and define the individual tray compartments may have become spattered or coated with food such as sauce or gravy which results in a somewhat less than palatable appearance of the tray when the food is served. Additionally, there may be some instances in which some of the food components will tend to give off water vapor during the heating process which may condense in droplets on some of the surfaces of the tray which are exposed when served. This, too, detracts from the appearance of the meal.

During the simultaneous heating of the food components, it is desirable that each of the individual food components be isolated from each other to preclude migration of food odors and water vapor between the food compartments. It therefore is desirable to employ some form of sealing arrangement to isolate the food compartments from each other. It is desirable that the seal be effective for its purpose yet also be easily broken so that the tray and cover may be separated easily without requiring difficult or awkward manipulations which could result in rough handling of the container. Such rough handling could cause some of the food components to smear the internal surfaces of the tray with resultant messy appearance of the tray when the cover is removed. If the manipulations required to uncover the tray are excessively awkward, that could even result in the contents of the tray being accidentally spilled. For example, U.S. Pat. No. 3,835,281 to Mannix discloses a differential heating container in which the lid and cover are sealed to each other about their peripheral rims and also employ an interlocking arrangement between the lid and cover ridges which require relative rotation of the tray and cover in order to separate them. In order to remove the cover from the tray, the peripheral rim seal somehow must be broken and then the tray and cover must be rotated relative to each other. Such manipulation is considered undesirable.

Also among the problems which have presented themselves is that after the meal has been heated in the microwave oven, sauces, gravies or toppings often tend to flow to the bottom of the food compartments when it would be preferable for these food components to be on top of their associated food at the time that the meal is served. In addition, some foods tend to have a somewhat dried-out appearance on their upper surface after heating when it would be preferred that they appear moist.

It is among the general objects of the invention to provide both a device and technique which overcomes these difficulties.

SUMMARY OF THE INVENTION

The invention is embodied in a container which includes a tray and cover which are formed from microwave-transparent, sheet plastic material in accordance with conventional thermoforming techniques. The tray has a bottom wall, a surrounding peripheral wall and one or more ridges which extend from the bottom wall and cooperate with the peripheral wall to define a plurality of compartments. The cover also is divided with ridges and walls which are arranged so that when the tray and cover are combined, the ridges will engage each other to define a plurality of isolated food compartments. In the present invention, the ridges on the tray are received within the ridges on the cover in a manner which effectively isolates the individual food compartments from each other and also in which the lid ridges cover and overlap a substantial portion of both sides of each of the tray ridges to cover and protect the tray ridges at all times. The cover also has outer wall portions which engage the inwardly facing portions of the peripheral wall of the tray to cover and protect those surfaces of the tray wall. The tray and cover are secured to each other about their rims which employ a snap-on peripheral fit. The cover may be detached easily from the tray by means of a tear tab which extends from the rim of the cover and which cooperates with weakened rupture lines on the cover. When the tear tab is pulled, the cover fractures along its tear lines to disrupt the snap-on fit between the cover and tray which thereafter enables the cover to be peeled off very easily with minimal force or manipulation.

The outer surfaces of each of the lid and tray may be shielded against the microwave energy by a thin film of radiation-opaque material such as metallic foil or ink except for those regions which are intended to define microwave-transparent openings. Alternatively, the differential shielding of the food components may be accomplished by providing a separate shielding box in the microwave oven. The shielding box is made from a radiation opaque material and has radiation transparent apertures formed therein. With this shielding technique, means are provided to insure that the container, which is entirely transparent to the microwave energy, is inserted into the shielding box in the proper position to insure proper alignment of the individual food compartments with their intended microwave-transparent apertures.

A further aspect of the invention relates to a method for packaging, heating and serving the meal in which the container is filled while in an inverted position. In this method, the food is inserted into the compartments defined in the cover, the meal is frozen or refrigerated in that attitude and is heated in that attitude in the microwave oven. The container is not returned to its normal tray-down attitude until it is served. When it is reinverted to its normal attitude, the component foods will fall into the tray compartments so that the most moist sides of the foods will face upwardly when the lid is subsequently removed. Sauces, toppings and other more fluent food components will be on top when the meal is served. The configuration of the cover and tray ridges in which the cover ridges and walls protect the inwardly facing surfaces of the tray ridges and walls and insures that none of the food will spatter or smear on the tray ridges or walls when the container is returned to its normal, tray-down attitude. When the container is used in this manner and with a separate shielding box, means are provided to insure insertion of the container in its inverted attitude.

It should be noted that often the foods in the meal will have been precooked and then frozen or refrigerated in the container. The foods preferably are slightly undercooked so that when heated to the intended serving temperature, the added heat may complete the cooking process. Because the step of heating the prefrozen or refrigerated meal both heats the food to its intended serving temperature and also partially cooks the foods, the application of heat is referred to herein "heat conditioning."

It is among the primary objects of the invention to provide an improved differential heating container for use in the microwave heat conditioning of a multi-component food.

A further object of the invention is to provide an improved differential heating container which insures that the foods will be served in a tray which has a clean appearance and in which the food is presented in a palatable manner.

Another object of the invention is to provide an improved differential heating container which insures that when the food is served its top, exposed surfaces will appear moist and freshly cooked and where fluid toppings such as sauces or gravy is employed, the fluid food component will be on top.

A further object of the invention is to provide an improved differential heating container including a separable tray and cover which effect a good seal between the food compartments yet which may be easily separated.

Another object of the invention is to provide an improved differential heating container in which the internal exposed surfaces of the serving tray portion of the container are protected from spattering or smearing.

A further object of the invention is to provide an improved differential heating container in which separation of the tray and cover does not require awkward manipulations.

Another object of the invention is to provide an improved method for packaging, microwave heating and sebsequent serving of a complete meal in which the food is packaged and heated in an inverted configuration.

Still another object of the invention is to provide an improved differential heating container which achieves the foregoing objects yet which may be manufactured at low cost and in accordance with conventional thermoforming techniques.

DESCRIPTION OF THE DRAWINGS

The foregoing and other objects and advantages of the invention will be understood more fully from the following further description thereof, with reference to the accompanying drawings wherein:

FIG. 5 is a sectional illustration of the container as seen along the line 5—5 of FIG. 2;

FIG. 6 is an illustration similar to FIG. 5 showing an alternative mating configuration of tray and cover ridges;

FIG. 7 is an illustration of the arrangement shown in FIG. 5 with the tray and cover ridges separated;

FIG. 8 is an illustration of the manner in which the container may be used in conjunction with a separate microwave shielding box;

FIG. 9 is an illustration of the container similar to FIG. 1 showing further modifications in which the tray ridges are of reduced height and in which a portion of the corner regions between the tray bottom, side wall and ridge are of an enlarged radius to facilitate spooning out of the contents;

DESCRIPTION OF THE PREFERRED EMBODIMENT

Figure 1:
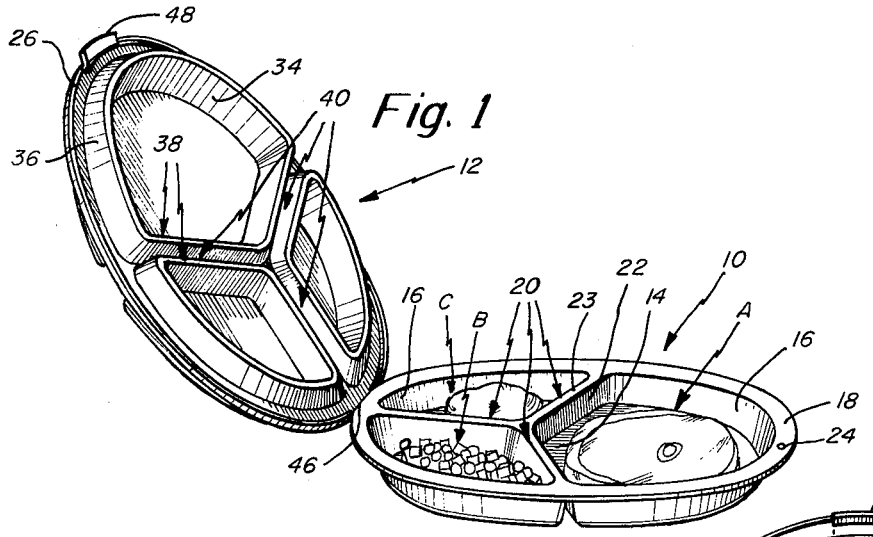
FIG. 1 is an illustration of the container bearing the meal in its tray portion and with the cover portion hinged back.

As shown in FIGS. 1–4, the container includes a tray 10 and cover 12 each of which is made from sheet plastic material in accordance with conventional thermoforming techniques. Each of the tray 10 and cover 12 are transparent to microwave energy. The tray includes a bottom wall 14 and a peripheral wall 16 which terminates at its upper edge in a curled rim 18. The interior of the tray 10 is divided into a plurality of compartments by ridges 20 which extend upwardly from the bottom wall 14 and inwardly from the peripheral wall 16. In the embodiment shown, the ridges 20 are arranged to define three food bearing compartments identified as A, B and C. Each of the tray ridges 20 is tapered upwardly and is defined by a pair of inclined sidewalls 22 which converge at the crest 23 of the ridge. In cross-section, the sidewalls 22 are arranged in an inverted-V configuration. The peripheral wall 16 of the tray is inclined upwardly and outwardly.

The cover 12 has portions which extend above the rim 18 and portions which protrude downwardly into the tray, below the level of the rim 18 when the cover and tray are combined. The periphery of the cover also includes a curled rim 26 which is slightly larger and longer than the tray rim 18 to define an underlying peripheral bead 28 which can snap-fit over the curled rim 18 of the tray to lock the cover 12 on the tray 10. A downwardly and outwardly flared skirt portion 30 may extend from the bead 28 to facilitate smooth engagement of the cover 12 and the tray 10. The foregoing arrangement insures a snug, firm, sealed fit about the periphery of the combined tray and cover.

Figure 4:
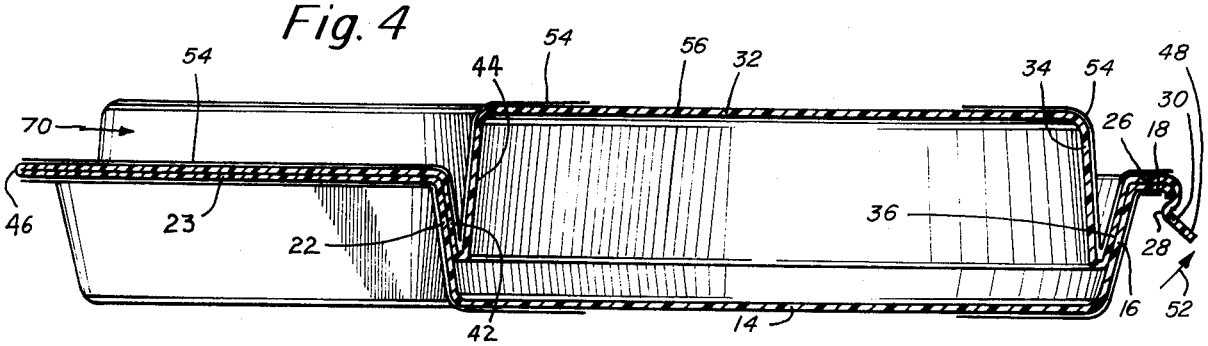
FIG. 4 is a sectional elevation of the container as seen along the line 4—4 of FIG. 2.

The cover 12 includes a top wall 32 which is located above the level of the cover rim 26, a compartment wall 34 which extend downwardly from the periphery of the top wall 32 to a level below the rim 26 and an upwardly extending peripheral wall 36 which terminates in the curled cover rim 26. The compartment wall 34 is inclined downwardly and outwardly and the peripheral wall 36 is inclined upwardly and outwardly in a V-shaped cross-sectional configuration. The inclination of the cover compartment wall 34 is such that when the cover 12 is secured on the tray 10, the cover peripheral wall 36 will lie against the inwardly facing surfaces of the corresponding tray peripheral wall 16 as shown in FIG. 4. The height of the cover peripheral wall 36 is such that it will cover and protect at least a substantial upper portion of the tray peripheral wall 16. For example, the cover peripheral wall 36 should cover no less than the upper quarter of the tray peripheral wall 16 and may coverly nearly the entire tray peripheral wall 36 as desired. The cooperation between the peripheral walls 36, 16 of the cover and the tray further enhances the seal of the compartments but in a manner which will present no difficulty to removal of the cover 12 when desired.

The cover also includes ridges which engage and cooperate with the tray ridges 20 to isolate the food compartments from each other as well as to protect the inwardly facing sidewall surfaces 22 of the tray ridges 20. The cover 12 has a pair of ridges 38 for each associated individual tray ridge 20. The ridges 38 in each of the cover pairs parallel each other and are spaced to define a channel 40. When the cover 12 is in place on the tray 10, each of the tray ridges 20 is received within the channel 40 of its associated pair of cover ridges 38. The cover ridges 38 extend from the top wall 32 of the cover 12 downwardly below the level of the cover rim 26 and protrude downwardly into the tray compartments to an extent sufficient to overlie at least the upper quarter of the sidewall surface of each tray ridge 20. If desired, the height of the cover ridges 38 may be such that they will extend almost fully to the bottom of the tray to nearly completely cover both sidewalls 22 of each tray ridge 20. Each of the cover ridges 38 is of generally V-shaped cross-sectional configuration and each pair of cover ridges 38 may be considered as defining a W-shaped cross-sectional configuration. Each of the cover ridges includes a channel-defining side wall 42 and a compartment-defining sidewall 44. The sidewalls 42, 44 converge in a downward direction and the inclination of the channel-defining sidewall 42 is such that it will engage the sidewall 22 of its associated tray ridge in flush abutment as shown in FIGS. 5 or 6. It should be noted that the downwardly diverging configuration of the cover channels 40 and the upwardly converging configuration of the tray ridges 20 merely fit against each other to provide effective isolation between the compartments and to cover the internal surfaces of the tray ridge sidewalls 22 but do not interfere or hamper with separation of the cover 12 from the tray 10. As shown in the drawings, the sidewalls of the ridges on each of the tray and cover merge smoothly and intergrally with their associated peripheral walls. From the foregoing, it will be appreciated that for each tray compartment, the cover 12 will have an arrangement of a peripheral wall portion and ridge means connecting the ends of the peripheral wall portion to define an endless V-shaped downwardly extending protrusion which will fit within its associated tray compartment in a snug engagement with the inwardly facing surfaces of the peripheral wall and ridges on the tray which define that tray compartment.

In the embodiment shown, the tray 10 and cover 12 are hinged together by a flexible, thin web 46 and the entire container may be molded in a single molding operation. When the tray 10 and cover 12 are hinged together as shown, the hinge 46 should be designed so that it can be easily broken, for example, it should be designed so that it will only withstand two or three cycles of operation in order to facilitate easy separation of the cover from the tray when the meal is to be served. It also should be noted that the configuration of each of the tray and cover, whether formed individually or as a single unit, enables them to be nested one in the other for compact storage and shipping. When the tray and cover are independent and are not joined by the flexible hinge, it may be desirable to employ indicia to facilitate proper orientation of the cover 12 when it is placed on the tray 10. By way of example, this may take the form of a mark in the form of a small dimple 24 molded into the rim region of the tray which can be aligned with the tab 48 (described below) of the cover 12.

In order to facilitate removal of the cover, a tab 48 is formed integrally with the cover rim 26. The tab 48 extends outwardly from the skirt 30, preferably at a location which is diametrically opposed from the hinge. A pair of weakened fracture lines 50 are formed in the cover rim 26 on either side of the tab 48 so that when the tab 48 is bent upwardly as suggested by the arrow 52 in FIG. 4, the rim 26 of the cover will rupture thus destroying the snap-fit seal and enabling the cover 12 to be easily peeled off of the tray 10 without requiring awkward manipulation.

Figure 2:
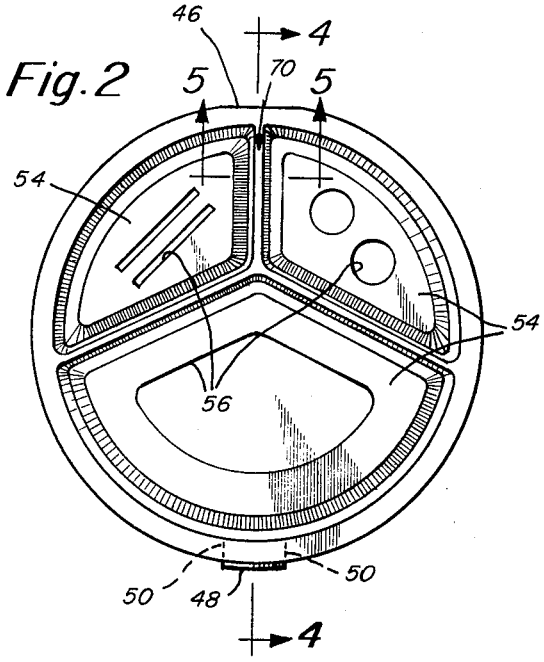
FIG. 2 is a plan view of the top of the container cover.
Figure 3:
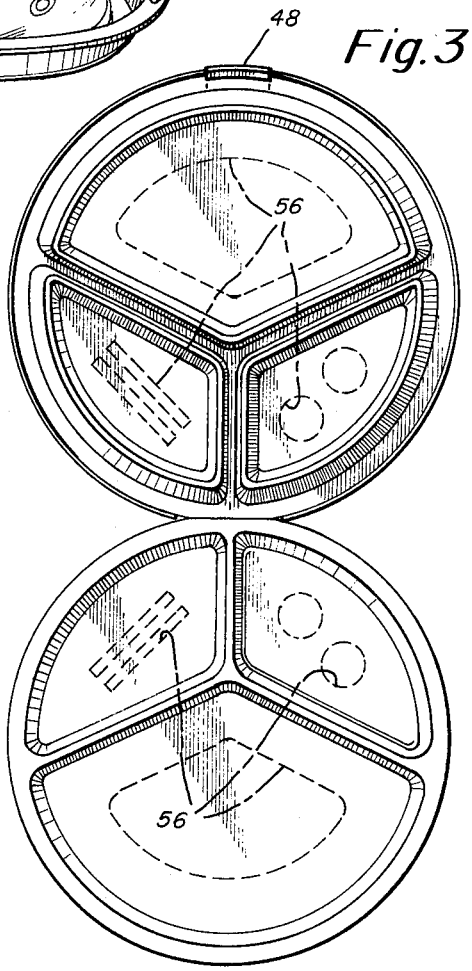
FIG. 3 is a plan view of the container with its tray and cover hinged apart.

FIGS. 2–4 also illustrate one means by which the food components in the container may be selectively shielded from microwave energy in order to properly and controllably heat condition each of the individual food components in the container. To this end, the outside surface of each of the tray and cover may be provided with a thin film 54 of material which is opaque to microwave radiation. The film typically will be metallic and may be laminated to the outside surfaces of the container. Alternatively, metallic inks may be applied to the container. Selected regions of the surfaces of the tray and cover are free of the shielding and define radiation transparent windows 56 of a size, shape and configuration which will control the amount of radiation to which the foods in the individual compartments may be exposed. Preferably, the radiation transparent apertures for each compartment are substantially identical so that when the cover is in place on the tray, the apertures in the cover will be in substantial alignment with the apertures on the tray.

FIG. 8 shows an alternative arrangement for selective shielding of the foods in the container in which the container is inserted into a separate, reuseable metallic shielding box 56. In this embodiment, the container remains entirely free of shielding films or coatings, the shielding being accomplished by the reuseable shielding box 56. The shielding box 56 includes top and bottom walls 58, 60, side walls 62 and a rear wall 64 and may be open at its front in order to removably receive the container. Radiation transparent apertures 66 are formed in each of the top and bottom walls 58, 60 and these apertures preferably are in substantial alignment with each other. Means are provided to insure that the container will be inserted into the shielding box 56 in an orientation which will insure that the food compartments will be in alignment with their intended radiation transparent apertures 66. To this end, a guide member 68 may be attached to the inside of the shielding box 56 at a location which will preclude the container from being fully inserted into the shielding box 56 except when the container is in the proper orientation. In the embodiment shown in FIG. 8, the guide member 68 is received longitudinally within one of the grooves 70 defined on the outside of the thermoformed cover. It should be noted that when this type of shielding device is employed, the ridges which define the tray and cover compartments are arranged to that only one of the outside grooves (the groove indicated at 70) extends radially, the other ridges and grooves being asymmetrically disposed so that they cannot fully receive the guide member.

Figure 11:
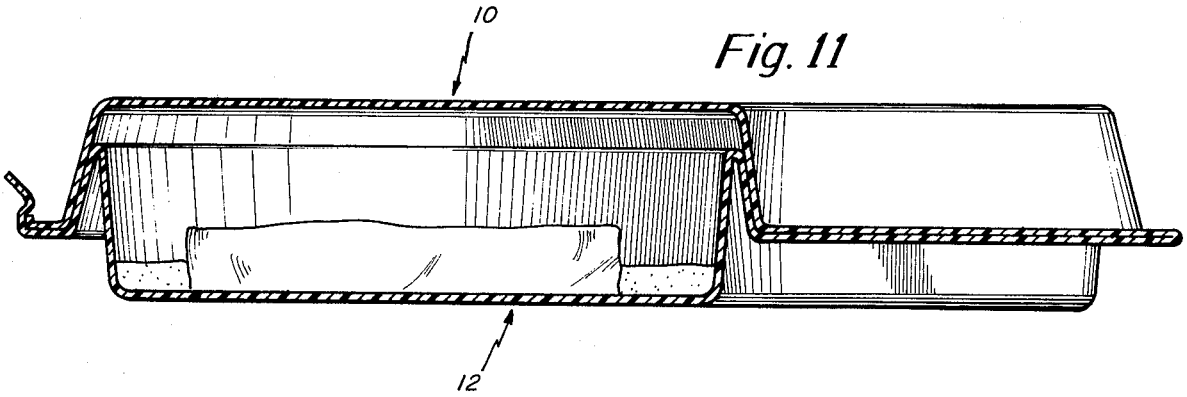
FIG. 11 is a sectional elevation of the container with food in its compartments and in an inverted position.

A further aspect of the invention relates to a method for packaging, cooking and serving a multi-component meal in a manner which insures that the appearance of the serving tray 10 will be clean and also in which the most moist appearing and most fluid foods will be on top when served. To this end, the container is filled in an inverted attitude. The partly cooked food is initially placed in the cover portion 12 of the container and the tray portion 10 is snapped on to serve, temporarily, as a lid. The packaged meal then may be frozen or refrigerated and stored with the container remaining in this inverted position (FIG. 11). No portion of the food engages the tray portion of the container which, at this time, serves as a lid. When the meal is to be heat conditioned, it is inserted into the microwave oven, still in its inverted attitude, and is heat conditioned with the food components resting in the cover compartments. Should any food spatter or tend to smear the inner surfaces of the container during the heat conditioning process or when the container is subsequently handled when brought to the person being served, the tray ridges 20 will be protected by the overlapping portions of the cover ridges 38 and cover peripheral wall 36. When the food finally is served, the container is then reinverted to its normal tray-down attitude to cause the foods to drop into their tray compartments. When the container is inverted, sauces and other food components will not mess the tray ridges 20 or tray sidewall 16 because they remain protected by the cover ridges 38 and sidewalls 36. Also, when inverted, sauces, topping and the like which were in the bottom of the cover compartment will be on top when the meal is served in the tray 10. After the container has been reinverted to its normal tray-down attitude, the tear tab 48 is pulled upwardly to break the snap-on seal and enable the cover to be easily peeled off without excessive or awkward manipulations. If the container employs a hinge 46, that can be snapped easily to completely separate the cover and enable the meal to be served in the tray alone.

Figure 10:
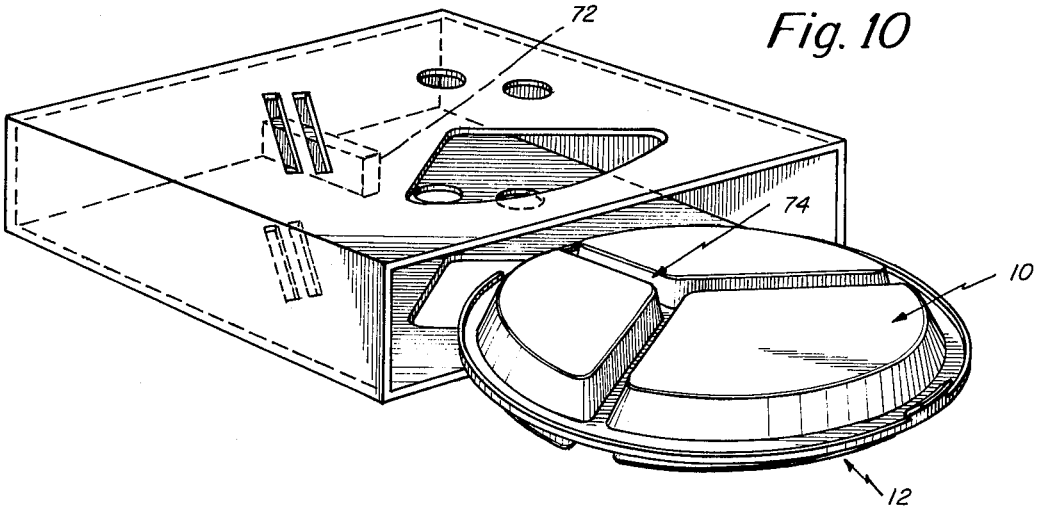
FIG. 10 is an illustration similar to FIG. 8 showing the insertion of the container in an inverted attitude into a microwave shielding box.

When the foregoing method of inverting and reinverting the container is employed in connection with a reuseable type of microwave shielding box, such as the box shown in FIG. 8, the guide means in the box preferably is of a configuration and is disposed to require insertion of the container not only in the proper angular orientation but also in the inverted, cover-down configuration. This is illustrated in FIG. 10 in which the guide member 72 is located on the internal end of the bottom wall 60 of the shielding box 56. The guide member defines a cross-sectional shape which will be receivable in the radial groove 70 of the inverted cover 12. It should be noted that the external groove 74 defined exteriorly of the tray 10 in association with the radial tray ridge 20 is not as wide as the external groove 70 defined by the W-shaped cover ridges 38. The insertion of the container other than in the inverted and angularly oriented attitude is thereby precluded.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. An apparatus for heat conditioning a multi-component meal by microwave energy comprising:

a tray formed from a material which is transparent to microwave energy, said tray including a bottom wall, an upwardly extending peripheral wall and ridge means extending upwardly from the bottom wall and being connected to the peripheral wall to define a plurality of tray compartments, the upper end of the tray peripheral wall terminating in a tray rim;

a cover formed from a material which is transparent to microwave energy, said cover having a peripheral rim constructed and arranged to engage and interlock with the tray rim, said cover having a top wall disposed above the level of the cover rim and a compartment wall extending downwardly from the periphery of the top wall, said compartment wall terminating below the level of the cover rim, said cover further having a peripheral wall connected to the lower end of the compartment wall and extending upwardly therefrom to the level of the cover rim, said cover rim being connected to the upper end of the peripheral wall of the cover;

said peripheral walls of said cover and tray being constructed and arranged to enable them to be mated when the cover and tray are combined;

said cover further including ridge means extending downwardly from the top wall and being connected to the cover compartment wall, said cover ridge means including a pair of paralleling spaced ridges defining channel means receptive to the tray ridge means when the cover is in place on the tray, said cover ridge means extending downwardly into the tray compartments to engage the side walls of the tray ridge means, the externally facing surface of said cover ridge means defining a radially extending groove;

and a microwave energy shielding means comprising:

a shielding box having top and bottom walls and an end wall, said box having means to removably insert said container therein;

means defining radiation transparent apertures in the walls of the shielding box at predetermined locations so that when the container is inserted into the shielding box in a predetermined orientation, selected of the radiation transparent apertures will be in alignment with selected portions of the container; and means mounted to and within the shielding box, said guide means being constructed and arranged to be received within the external radially extending groove of the container cover and being further constructed and arranged as to preclude insertion of the container other than in an inverted, cover-down attitutde and with the tray in said predetermined orientation.

* * * * *